US010808394B1

(12) United States Patent
Dewing et al.

(10) Patent No.: US 10,808,394 B1
(45) Date of Patent: Oct. 20, 2020

(54) PREFABRICATED MODULAR STRUCTURE

(71) Applicants: Ken Dewing, Bakersfield, CA (US); Robert C Davis, Exeter, CA (US); Jesse Sanchez, Porterville, CA (US)

(72) Inventors: Ken Dewing, Bakersfield, CA (US); Robert C Davis, Exeter, CA (US); Jesse Sanchez, Porterville, CA (US)

(73) Assignee: Endurequest Corporation, Porterville, CA (US)

( * ) Notice: Subject to any disclaimer, the term of this patent is extended or adjusted under 35 U.S.C. 154(b) by 0 days.

(21) Appl. No.: 13/776,342

(22) Filed: Feb. 25, 2013

Related U.S. Application Data

(60) Provisional application No. 61/603,106, filed on Feb. 24, 2012.

(51) Int. Cl.
*E04H 1/00* (2006.01)
*E04B 1/32* (2006.01)

(52) U.S. Cl.
CPC ..... *E04B 1/32* (2013.01)

(58) Field of Classification Search
CPC ..... E04C 3/005; E04D 3/362; E04B 1/3211
USPC ..... 52/79.1, 86, 81.2, 537, 93
See application file for complete search history.

(56) References Cited

U.S. PATENT DOCUMENTS

| | | | | | |
|---|---|---|---|---|---|
| 2,073,185 | A * | 3/1937 | Shafer | 52/293.3 |
| 2,278,956 | A * | 4/1942 | Wagner | 52/81.4 |
| 3,748,796 | A * | 7/1973 | Ouellet | 52/86 |
| 3,807,088 | A * | 4/1974 | Jones | 47/62 N |
| 3,974,602 | A * | 8/1976 | Pohl et al. | 52/93.1 |
| 4,068,423 | A * | 1/1978 | Marsh | 52/86 |
| 4,099,359 | A * | 7/1978 | Sivachenko | 52/630 |
| 4,435,934 | A * | 3/1984 | Kim | 52/309.7 |
| 5,333,421 | A * | 8/1994 | McKenna | 52/86 |
| 5,361,556 | A * | 11/1994 | Menchetti | 52/561 |
| 5,385,423 | A * | 1/1995 | Abukawa | 403/245 |
| 5,501,046 | A * | 3/1996 | Hattingh et al. | 52/266 |
| 5,611,178 | A * | 3/1997 | Aubert | 52/169.6 |
| 6,131,343 | A * | 10/2000 | Jackson, Jr. | 52/86 |
| 2011/0219707 | A1* | 9/2011 | Kitagawa | 52/79.1 |

* cited by examiner

*Primary Examiner* — Basil Katcheves
(74) *Attorney, Agent, or Firm* — R. Scott Kimsey, Esq.

(57) ABSTRACT

A modular structure includes a sill and a plurality of interlocking panels. The interlocking panels are attached to one another to form a panel assembly having a first end and a second end. The first end of the panel assembly is attached to a first side of the sill, and the second end of the panel assembly is attached to a second, opposing side of the sill.

2 Claims, 10 Drawing Sheets

PREFABRICATED MODULAR STRUCTURE

RELATED APPLICATIONS

This Application claims priority of U.S. Provisional Patent Application No. 61/603,106, filed Feb. 24, 2012 and entitled "Prefabricated Modular Structure" and incorporated herein by reference in its entirety.

BACKGROUND OF THE INVENTION

1. Field of the Invention

The present invention relates generally to a modular structure, and more specifically to prefabricated, modular, quonset-hut type structure.

2. Background

Prefabricated structures such as quonset huts have a wide variety of military and civilian applications. The components of the structures are light-weight, easy to ship, and readily assembled on-site without the use of highly skilled labor. These structures are generally all metal and include a series of arcuate ribs onto which corrugated sheets of tin, galvanized steel, or other metal are secured. The metal sheets are secured to the ribs by riveting, welding, or other methods. Often, the metal sheets are prefabricated with an arc matching that of the arcuate ribs so that the metal sheets maybe more easily secured to the ribs. The final structure has a hemispherical shape.

Structures of the type described above offer a number of advantages. As noted above, the components are relatively light-weight and easy to assemble. Further, the structures are suitable for use in a wide variety of environments, with the shape of the structure providing a high degree of structural stability. The structures are resistant to damage from high winds and weight accumulation during heavy snow. Nevertheless, traditional structures are also subject to disadvantages.

Although easily transportable and light-weight by comparison to many other structures, the prefabricated structures described above are still too heavy for the component parts to be easily transported by individuals as opposed to vehicles or other machinery. Lighter materials tend to provide less permanent structures. Thin plastics used in some structures degrade over time and must be replaced. Other materials, such as thermoplastic materials, are too soft to be securely affixed to one another using invasive fasteners, like screws, and relatively insecure, non-invasive fasteners like clips are often used to join adjacent components. Such less than secure fastening often renders the structure as a whole permeable to water. Metal structures are also subject to internal condensation.

What is needed, then, is a modular structure readily assembled from prefabricated materials that can be easily transported by individuals, while still providing a stable, water-tight, securely-fastened structure.

SUMMARY OF THE INVENTION

The present invention provides a modular structure comprising a sill forming a base of the modular structure, and a plurality of interlocking panels. The interlocking panels are attached to one another to form a panel assembly having a first end and a second end. The first end of the panel assembly is attached to a first side of the sill, and the second end of the panel assembly is attached to a second, opposing side of the sill.

In another aspect of the present invention, the interlocking panels include first and second coupling joints, one at each opposing long end of each panel. The first and second coupling joints are sized and shaped to mate with one another for attaching a first interlocking panel to a second interlocking panel.

In another aspect of the present invention, the interlocking panels have a compound curve for added strength and for allowing the assembly of various curved structures, including domes and oblong curved enclosures.

In another aspect of the invention, the interlocking panels are constructed from a material capable of maintaining structural integrity upon receipt of an invasive fastener, such as a screw.

In another aspect of the present invention, the interlocking panels are constructed from a thermoset polymer.

In another aspect of the invention, the modular structure includes weather stripping between the interlocking panels to provide a weather-tight structure.

In still another aspect of the invention, the modular structure includes a plurality of arcuate ribs extending from a first side of the sill to a second, opposing side of the sill. At least one panel assembly is disposed between each adjacent pair of arcuate ribs.

In still another aspect of the invention, the modular sill includes a plurality of interlocking side members and a plurality of corner members. The interlocking side members and corner members are fastened together to form a closed sill.

In another aspect of the invention, the interlocking side members and corner members of the sill form a wiring channel inside the modular structure for housing wiring used in conjunction with the modular structure.

In another aspect of the invention, the interlocking side members and corner members of the sill form a water channel for directing water away from the modular structure.

In another aspect of the invention, each of the interlocking side members includes an upper tab at one end of the interlocking side member and a lower tab at the other end of the interlocking side member. The upper tab of one interlocking side member is sized and shaped to mate with the lower tab of another interlocking side member.

In another aspect of the invention, the upper and lower tabs each define an opening for receiving a fastener to attach one structure to another.

In another aspect of the invention, the modular structure includes at least one end piece. The end piece includes a plurality of end piece rib members and a plurality of end panels attached to form the end piece to the modular structure.

In another aspect of the invention, the sill includes a gasket on an underside thereof. The gasket is at least partially deformable under the weight of the modular structure when the modular structure is fully constructed and resting on a surface.

In another aspect of the invention, the sill includes a receptacle mount formed in a surface thereof. The surface forming the receptacle mount is exposed to an interior of the modular structure when the modular structure is constructed.

In another aspect of the invention, the first coupling and joint and second coupling joint of the interlocking panels are hemi-hexagonal in shape.

In another aspect of the invention, the interlocking panels include a first longitudinal edge and a second, opposing longitudinal edge. The first and second longitudinal edges extend between first and second ends of the interlocking panel. The first and second longitudinal edges of the interlocking panels are sized and shaped to mate with one another for attaching one interlocking panel to another interlocking panel.

In another aspect of the invention, the interlocking panels include a first longitudinal edge and a second, opposing longitudinal edge. The first and second longitudinal edges extend between first and second ends of the interlocking panel. The first and second longitudinal edges of the interlocking panels include upper and lower tabs, respectively, that are sized and shaped to mate with one another for attaching one interlocking panel to another interlocking panel.

Another aspect of the invention provides a kit for constructing a modular structure. The kit includes a plurality of interlocking side members, a plurality of corner members, a plurality of interlocking panels, and a plurality of arcuate rib members. The interlocking side members and corner members are sized and shaped to attach to one another to form a base of the modular structure. The arcuate rib members are sized and shaped to form an arcuate rib, which is in turn sized and shaped to attach to a first side of the base at one end of the arcuate rib and a second side of the base at a second end of the arcuate rib. The plurality of interlocking panels are sized and shaped to attach to one another to form at least one panel assembly. The panel assembly is sized and shaped to attach to the first side of the base at one end of the panel assembly and a second side of the base at a second end of the panel assembly. At least one panel assembly and the arcuate ribs are sized and shaped to attach to one another along a longitudinal edge of each to form a completed modular structure.

In another aspect of the invention, the kit also includes a plurality of fasteners for attaching the interlocking side members, corner members, interlocking panels, and arcuate rib members.

DETAILED DESCRIPTION OF THE INVENTION

It should be noted at the outset that that the phrase "thermoset plastics" will be used to described some of the materials used in the construction of the present device. It is contemplated that such use is exemplary and components so described are not limited to such materials. Any suitable materials may be used, including light-weight materials such as carbon fiber.

Thermosetting plastics, or "thermoset" plastics, are stronger than traditional thermoplastic materials. Thermoset plastics harden during the molding process, and do not soften after solidifying. These plastics acquire a three-dimensional cross-linked structure with predominantly strong covalent blonds that retain their strength and structure, even upon heating. Thermoset plastics strengthen upon being heated and are irreversibly cured. They cannot be successfully remolded or reheated after initial forming. Thermoset plastics have greater dimensional stability than thermoplastics, and generally have greater strength and hardness. Examples of thermoset plastics include amino, epoxy, phenolic, and unsaturated polyesters, as well as polyurethanes and silicon polyamides.

Figure 1:
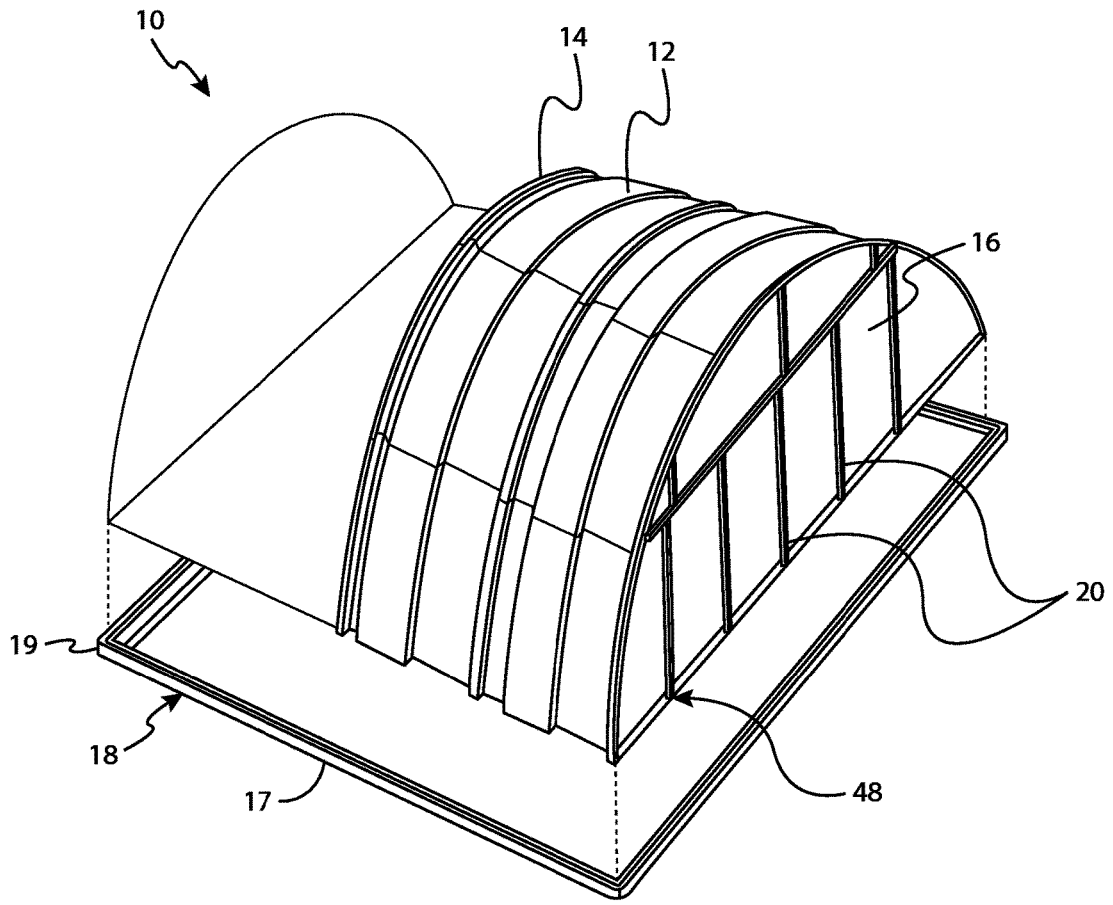
FIG. 1 depicts a partially-constructed exemplary embodiment of a modular structure of the present invention fabricated with flat panels, with the upper portion of the structure shown in exploded view with respect to the sill.

An exemplary modular structure 10 of the present invention is shown in FIG. 1. Modular structure 10 includes, generally, interlocking panels 12, a series of arcuate ribs 14, end panels 16, and sill 18, which is comprised of interlocking side members 17 and corner members 19. These and other features of the present invention are described in greater detail, below.

The base or "sill" of the present modular structure preferably comprises a plurality of horizontal interlocking side members 17. At the corners of the structures, these interlocking side members 17 engage with sill corner members 19 to form a complete sill 18. FIG. 1 depicts interlocking side members 17, sill corner members 19, and the completed sill 18, with a partially constructed modular structure 10 shown as an exploded view, positioned above sill 18. It is contemplated that the sill may be anchored to the ground where the present modular structure is being constructed, or that the base may simply rest on the surface of the ground, which is useful in situations wherein the surface of the ground is not susceptible to the use of anchors or when a user of the present modular structure does not have anchors available.

Figure 2:
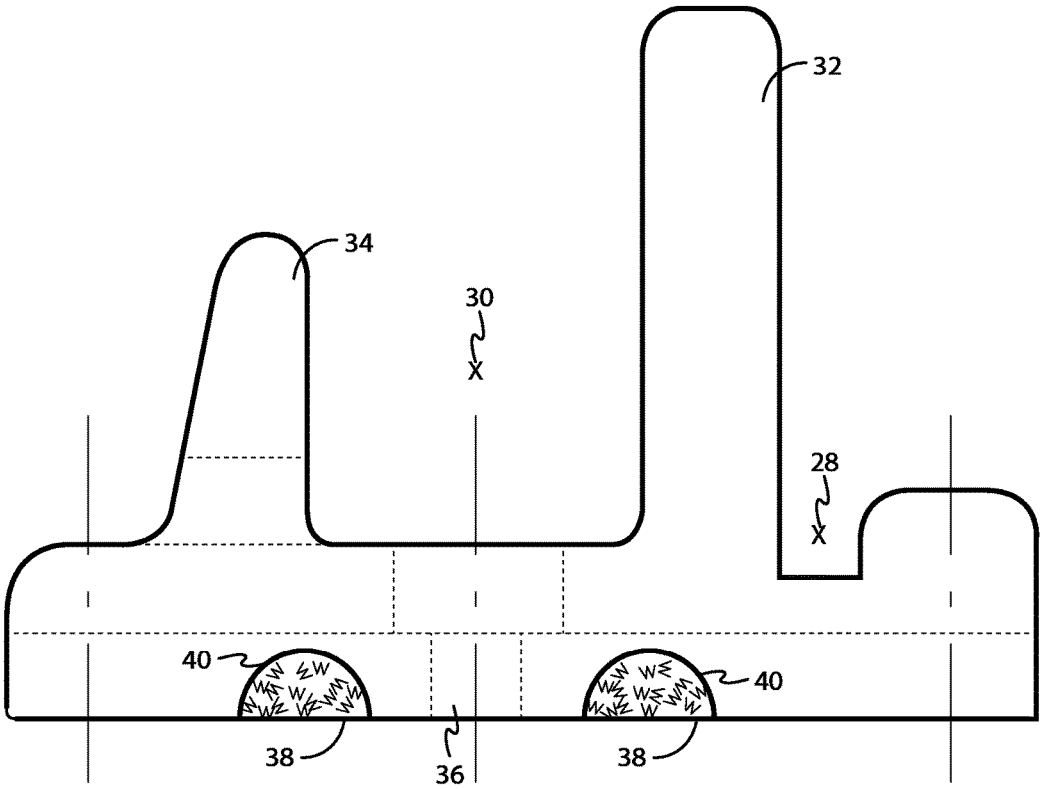
FIG. 2 is a cross-section view of an exemplary interlocking side member of a sill of the present invention.

FIG. 2 depicts a cross-section view of an exemplary interlocking side member 17 of sill 18. In the orientation shown in the figure, the left side of the interlocking side member 17 is disposed to the exterior of modular structure 10, whereas the right side of interlocking side member 17 is disposed to the interior of modular structure 10. Interlocking side member 17 preferably includes a wiring channel 28 for receiving wiring necessary or desired to be distributed throughout the completed structure. The wiring may be used to provide power, and a standard socket may be mounted on receptacle mount 32. In addition, wiring channel 28 may contain a coaxial cable, with a standard cable mount being mounted on receptacle mount 32 of any given interlocking side member 17. A larger channel 30 is provided for receiving an end of an interlocking panel 12, described in greater detail below. The bottom surface of channel 30 may include an opening 36 extending therethrough for receiving a fastener for anchoring sill 18 to a desired surface. Further, the opening may receive a fastener for securing an interlocking panel to interlocking side member 17. It is contemplated, however, that an interlocking panel 12 may be attached to interlocking side member 17 in any suitable manner. Support member 34 provides additional structural support for an interlocking panel 12 attached to interlocking side member 17. It is also contemplated that some embodiments of interlocking side member 17 include one or more gasket channels 40 for receiving gaskets 38. Gaskets 38 may be comprised of rubber, neoprene, or any other suitable material. Gaskets 38 provide a relatively soft underside to the present modular structure and are able to conform (to varying degrees depending on the material used) to the surface of the ground in order to prevent movement of water into the space beneath the structure, as well as to keep out insects or other pests.

Figure 3:
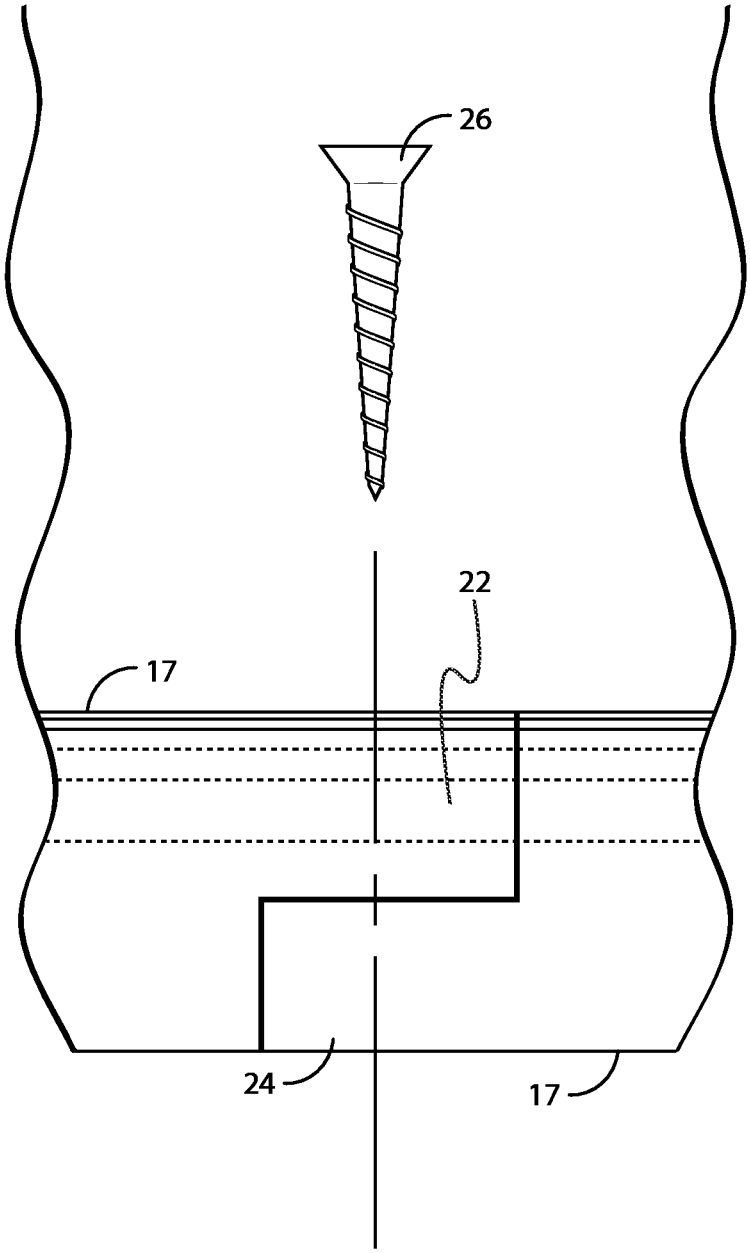
FIG. 3 is a detailed view of an attachment between two interlocking side members of a sill adapted to receive a fastener for attaching the two side members.

Adjacent interlocking side members 17 are preferably fastened using a fastener 26 such as a screw or other suitable device, as shown in FIG. 3. Opposing ends of interlocking side members 17 preferably include tabs, with a first, upper tab 22 on one end of an interlocking side panel 17 mating with a second, lower tab 24 on an opposing end of a separate interlocking side member 17. The ends of sill corners 19 preferably include this same tab structure, allowing sill corners 19 to receive interlocking side members 17 at each end thereof. This tabular arrangement is also shown in FIG. 3.

Figure 4:
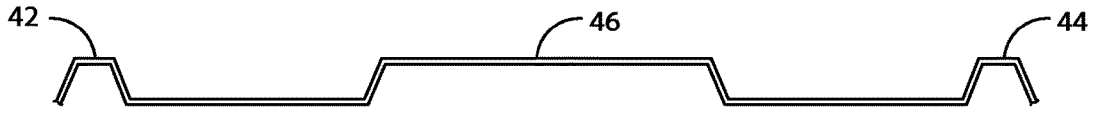
FIG. 4 is a line diagram showing the general shape of an exemplary interlocking panel of the present invention.

FIG. 4 is a simple line diagram providing the general shape and curvature of a cross-section view of an exemplary interlocking panel 12 of the present invention. As can be seen from the figure, interlocking panel 12 includes first and second coupling joints 42 and 44, respectively located at opposing ends of interlocking panel 12. An extending section 46 is located at, or approximately at, the center of interlocking panel 12. The presence of coupling joints 42 and extending section 46 provides greater structural strength to interlocking panel 12 as compared to, for example, a flat panel. Further, interlocking panels 12 preferably include a compound curve for added strength, though it is contemplated that the principles of the present invention may be applied when constructing interlocking panels 12 that do not include a compound curve. Coupling joints 42 also provide an easy and structurally-sound mechanism for attaching two interlocking panels 12.

Figure 5:
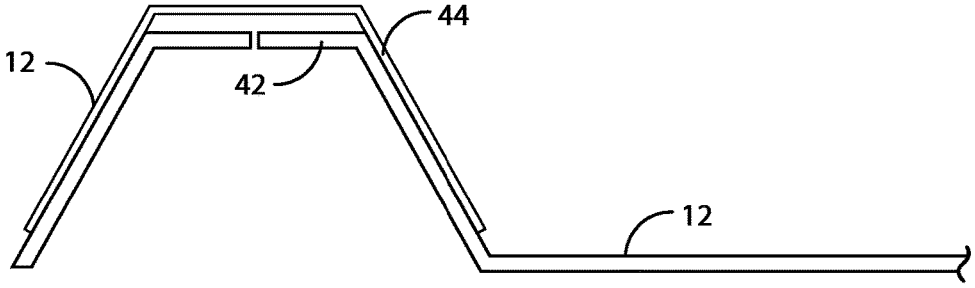
FIG. 5 is a detailed view showing and exemplary embodiment of the coupling joints of two interlocking side panels.

An attachment of two interlocking panels 12 is shown in the detailed view provided in FIG. 5. As shown in the figure, coupling joint 44 of a first interlocking panel 12 receives coupling joint 42 of a second interlocking panel 12. The arrangement is such that the undersurface of coupling joint 44 of the first interlocking panel 12 engages the upper surface of coupling joint 42 of the second interlocking panel. A fastener (not shown) may be used to securely attach the two coupling joints 42 and 44 along the dashed lines shown in the Figure. Any suitable fastener may be used for this purpose, though the strength and stability of an 'invasive' fastener, such as a screw, is preferred. As shown in the Figures, coupling joints 42 and 44 have a generally hemi-hexagonal shape. It is contemplated that this is one exemplary embodiment of an interlocking panel 12, and that coupling joints 42 and 44 may have any suitable shape that allows a similar engagement between the coupling joints. Structurally-mated coupling joints of the type shown provide an advantage over simply fastening two flat panels to one another in that the shape of the coupling joint provides added structural stability and greatly minimizes shearing forces at the site of the fastener. In a flat panel, shearing forces at the site of the fastener can cause damage to the material of the panel, thereby causing loosening of the fastener and compromising the structural integrity of the modular structure.

Turning again to FIG. 1, it can be seen that interlocking panels 12 are capable of attaching to one another both at the ends and along their length. The length of interlocking panels 12 preferably include a tabular design, similar to that shown in FIG. 3 with respect to the interlocking side members 17 of sill 18. Any suitable mechanism or structure for mating interlocking panels 12 along their lengths may be utilized, and in some embodiments interlocking panels 12 may simply include flat or smooth sides that contact one another in a tight fit. Further, in some embodiments of the invention, interlocking panels 12 may include coupling joints similar to those provided at the ends of interlocking panels 12. Such coupling joints may extend along some or all of the length of the long sides of the interlocking panels 12. An assembly of two or more interlocking panels 12 is referred to here as a 'panel assembly.' In any of the above embodiments, weatherstripping, or caulk or other compounds may be used at the joints or seams of the interlocking panels 12 or other structural portions of the present invention in order to ensure a watertight end product. Any suitable structure for attaching or interlocking a plurality of interlocking panels 12, or end panels 16 (described below), may be provided at the ends or along the longitudinal edges of the panels. These same structures may be used to attach interlocking panels 12 or end panels 16 to portions of the sill or arcuate ribs. Further, in some embodiments of the invention, different types of structures for attaching components of the invention may be provided along different edges of the same component of the present invention. Such variation among connecting structures can be used to ensure flush contact between panels seams in some embodiments of the invention.

Embodiments of modular structure 10 also include a plurality of arcuate ribs 14. It is contemplated that most modular structures constructed in accordance with the teachings of the present invention will include at least two arcuate ribs 14, one at each end of the structure. Arcuate ribs 14 preferably include the tabular structure described above with respect to the lengthwise attachment of interlocking panels 12, thereby allowing interlocking panels 12 to be readily affixed to arcuate ribs 14. Any suitable shape or mechanism for attachment may be utilized, and the same is true of attaching the opposing ends of arcuate ribs 14 to sill 18. In a preferred embodiment of the invention shown in FIG. 1, an arcuate rib 14 is present for every three sections of interlocking panels 12 (in other words, for every three panel assemblies). This arrangement provides adequate structural strength to the modular structure 10. It is contemplated, however, that more or fewer arcuate ribs 14 may be employed in the construction of modular structure 10. It is further contemplated that arcuate ribs 14 may be provided in smaller portions or sections (for example, five curved rib portions) that can be attached to one another to form a completed arcuate rib 14. This allows easy transport of the portions of arcuate rib 14, eliminating the need to transport a completed arcuate rib 14 to the site where a modular structure 10 is to be built.

Also shown in FIG. 1 is the construction of an end piece 48. The end piece 48 is constructed of a plurality of end piece ribs 20 with end panels 16 disposed therebetween. As with arcuate ribs 14, described above, end piece ribs 20 may be constructed from smaller rib portions, attached end to end to form a complete end piece rib 20. Attachment mechanisms for securing the end panels 16 to end pieces ribs 20 are preferably substantially as described above with respect to attachment of other structural elements of the present modular structure 10, though once again it is contemplated that any suitable method of attaching the various modular elements may be utilized. Further, it is contemplated that one or more end panels 16 may be left out to form an open doorway, or that a door may be built into the present modular structure 10 in place of one or more of end panels 16. In some embodiments, a modified end panel 16 may be provided, the end panel 16 constructed so that it attaches to the greater structure in the same manner as the other end panels 16, but with a door built into the end panel 16 itself. Further, end panels 16 or interlocking panels 12 may be provided with windows or other structures formed therein as shown, for example, in FIG. 6.

As can be seen from the figures and from the disclosure above, the modular nature of the present invention allows almost unlimited variation in the dimensions of a given modular structure 10. Because the various components of the modular structure are light-weight and readily transportable, individuals wishing to construct a modular structure 10 are able to readily transport the various panels, sill members, and arcuate rib members needed for construction of a modular structure 10. The components of the present invention are light enough to be carried, singly or in stacks, by individuals. While the size of the individual components may vary, they are preferably also of a size to allow ready transport by individuals (for example, interlocking panels 12, in some embodiments, are around four feet in length). Individuals wishing to construct a modular structure 10 can transport components of the structure according to the desired final dimensions of modular structure 10. For a twenty-by-twenty modular structure 10, for example, it is contemplated that, in some embodiments, the final structure may require five arcuate ribs, seventy-five interlocking panels, four sill corner members, twelve interlocking side members, and materials for two end pieces. In addition, fasteners must be provided to construct the final modular structure 10. In some embodiments of the invention, a kit may be provided having all of the components necessary for building a modular structure of the present invention.

In addition to the embodiments described above, it is contemplated that various design and structural modifications will be readily available to those of ordinary skill in the art, and such modifications are contemplated to fall within the spirit and scope of the present invention. For example, Pre-formed door and window structures may be provided for easy integration into the modular structure. Further, modular structures may be provided with rounded ends rather than the flat end piece shown in the exemplary embodiments above. In such embodiments, arcuate rib structures may extend outwardly to form the end pieces of the structure as well as the side pieces. The present modular structure may be elongate, or may be circular. In circular embodiments, a centerpiece structure may be located at the top of the structure with arcuate ribs extending, space apart, in all directions from the center piece to the outer perimeter of the structure. In addition, the sill portion of the present structure may be provided with interlocking floor panels to form the floor of the structure. Such panels may include gaskets, weatherstripping, caulking, or other methods of ensuring that they fit together in a watertight arrangement. Such embodiments are exemplified in FIGS. 6-10, which generally depict a circular structure 100 and an elongate structure 200 which utilizes spherical end sections to close the structure on one or both ends.

Figure 6:
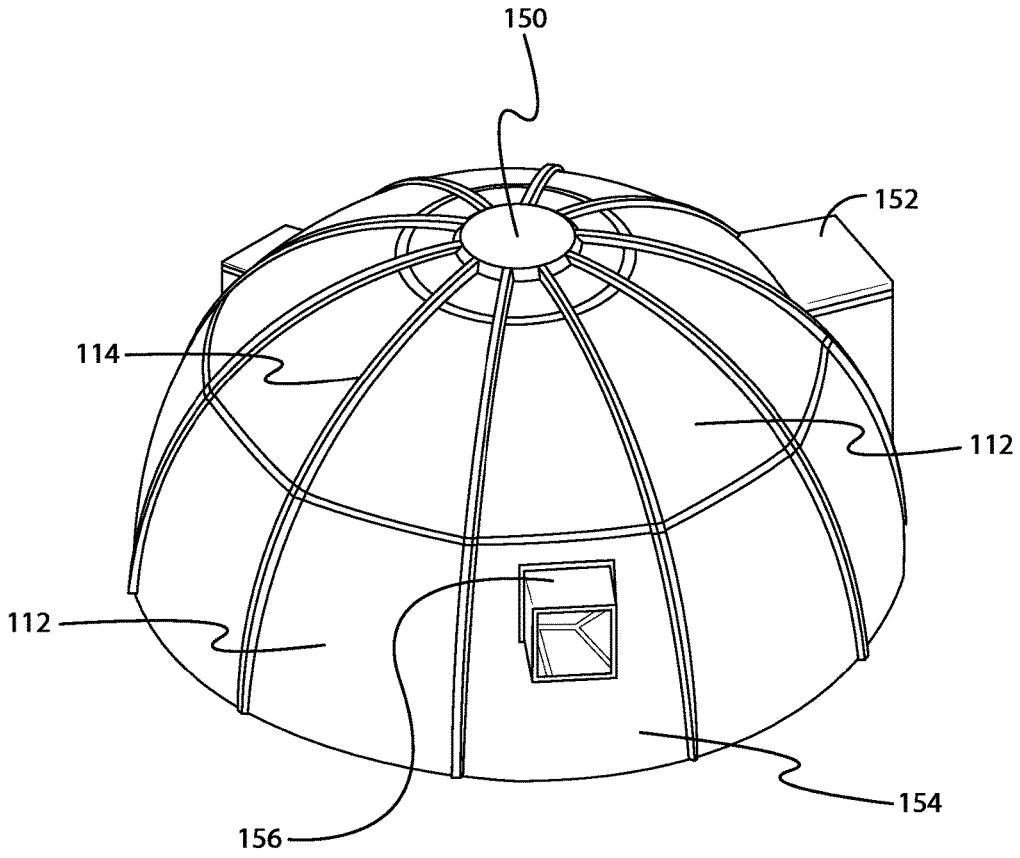
FIG. 6 is a perspective view of a domed structure which may be fabricated from interlocking panels having a compound curve.
Figure 7:
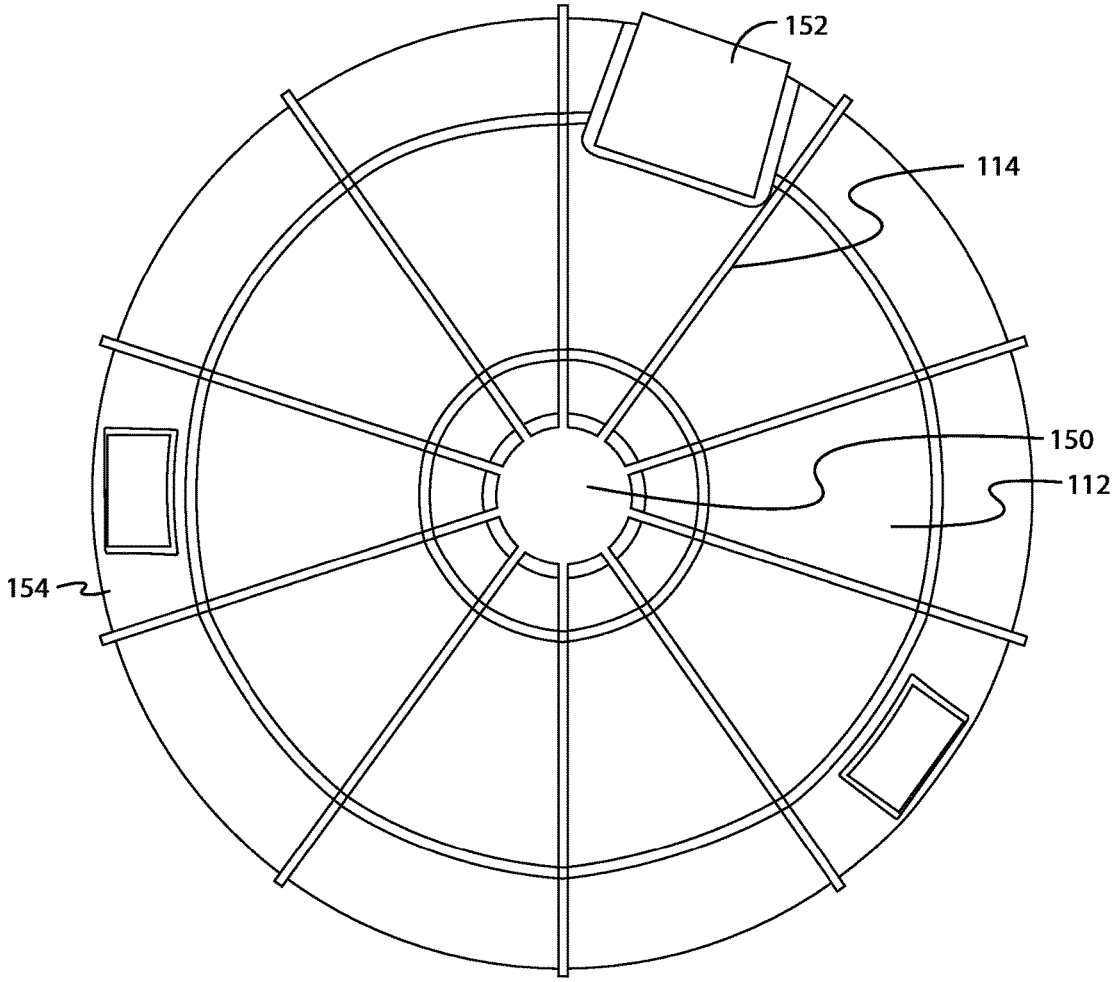
FIG. 7 shows a top view of the structure shown in FIG. 6.
Figure 8:
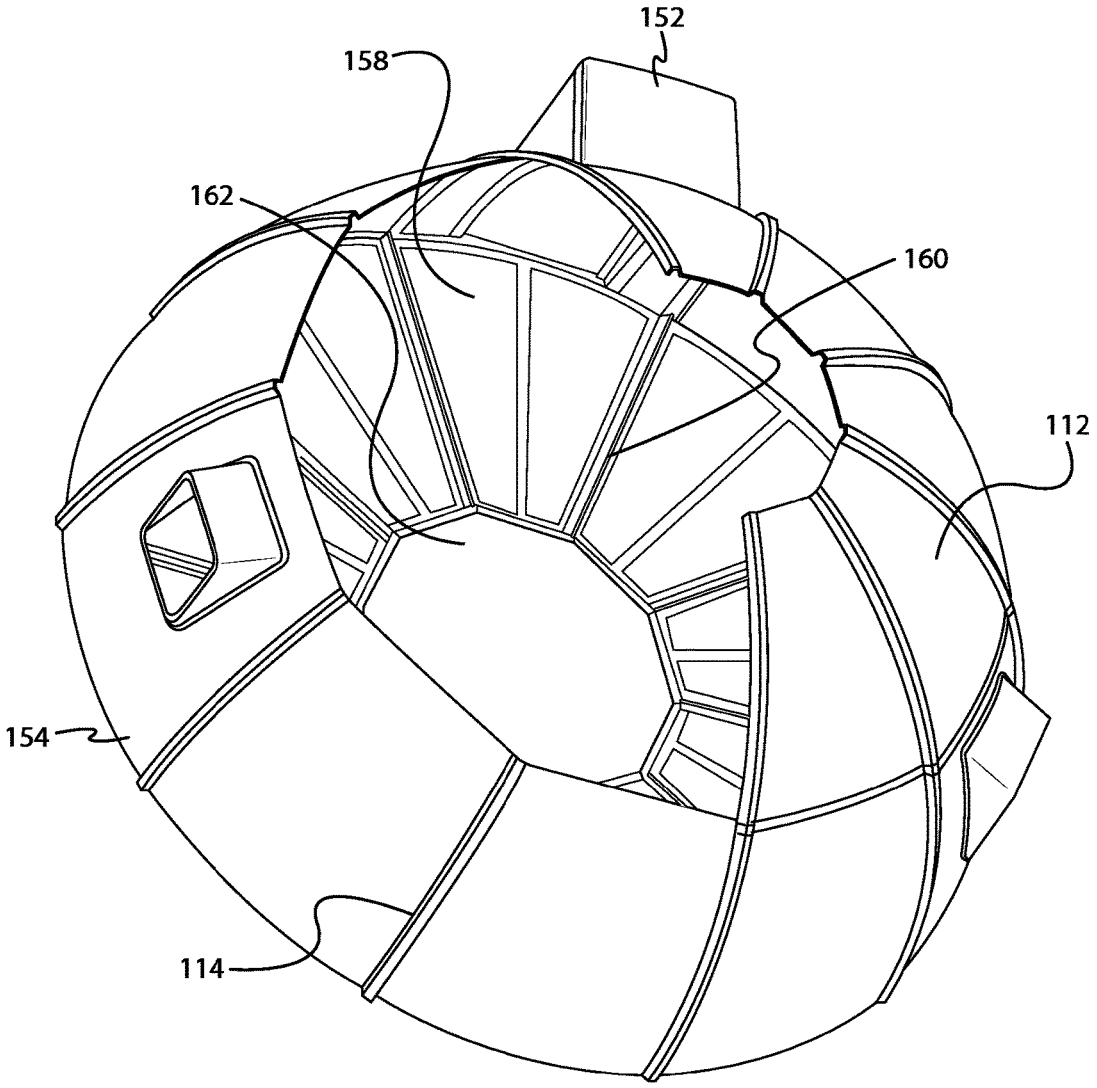
FIG. 8 is a perspective partial cutaway view of the structure depicted in FIG. 6.

FIGS. 6 through 8 show one embodiment of a rounded modular structure 100 of the present invention. Structure 100 includes interlocking panels 112 and arcuate ribs 114. Further, a window panel 154 is provided having a window 156 formed therein. It is contemplated that window panel 154 have tabs, coupling joints, or other suitable attachments members along the edges thereof, as described with respect to interlocking panels 12, above. A top hub 150 forms a central structure to which other structures of the present invention may attach. Also provided is a door 152, which may be built into its own panel or may fully cover the space normally occupied by an interlocking panel, in which case the door has connecting structures just as tabs or connecting joints associated therewith to allow attachment of door 132 to modular structure 100. As shown in FIG. 8, which also allows a view of the interior of modular structure 100, the floor of the modular structure includes interlocking floor panels 158 and floor ribs 160. These may be provided in any necessary or desired size and shape, and connect to one another in the same exemplary manners described above with respect to interlocking panels 12 and arcuate ribs 14. It is contemplated that any of the embodiments of the modular structure of the present invention may include floor panels and floor ribs as shown in FIG. 8, or that in some embodiments of the invention the floor portion of the modular structure is left open to the ground.

Figure 9:
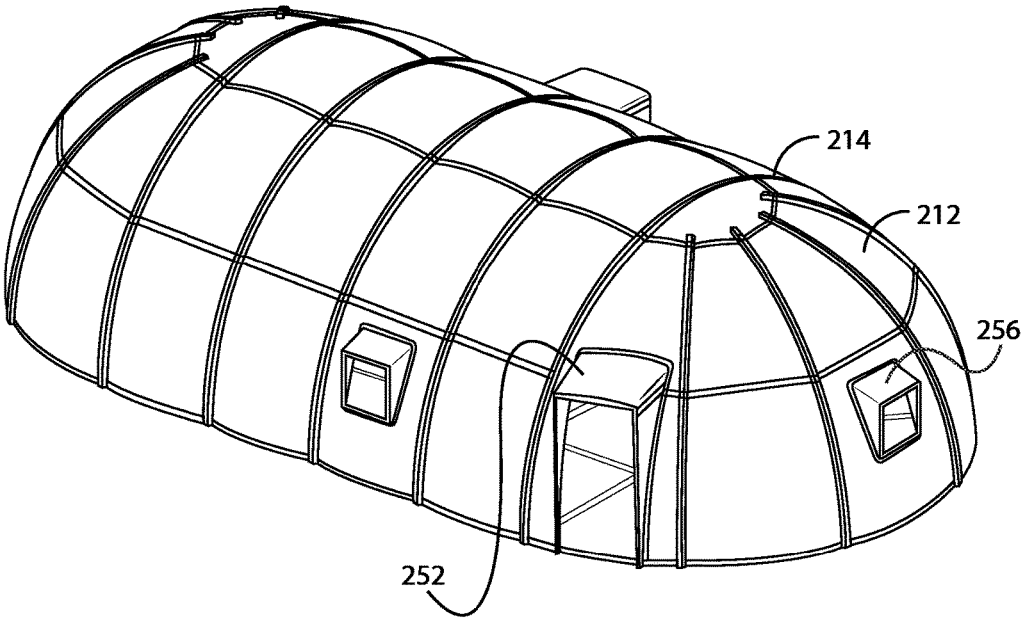
FIG. 9 is a perspective view of a oblong structure which may be fabricated by combining the central portion of a structure as generally depicted in FIG. 1, with hemispherical sections, as generally depicted in FIG. 6, added as end closures.
Figure 10:
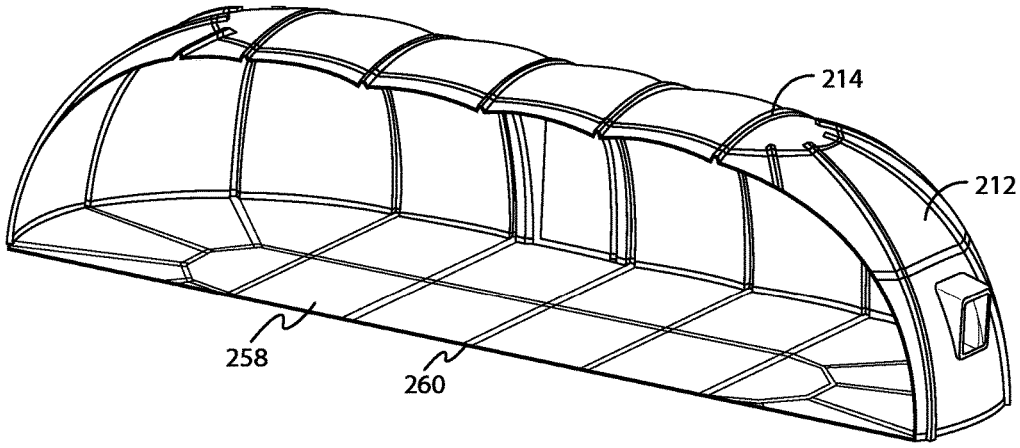
FIG. 10 is cut-away view of the oblong structure depicted in FIG. 9.

FIGS. 9 and 10 show an embodiment of an elongate modular structure 200 of the present invention. The structure includes interlocking panels 212 and arcuate ribs 214. Also provided are window panels 256 and door 252. As shown in FIG. 10, the floor of the exemplary elongate embodiment shown in FIG. 10 further includes interlocking floor panels 258 and floor ribs 260. Any of a variety of shapes, sizes, and combinations of the modular structure of the present invention may be constructed in accordance with the principles set forth herein. For example, two rounded structures such as that shown in FIG. 6 may be at either end of a larger structure, with an elongate structure extending between them. The modular nature of the present invention allows wide flexibility in terms of variations in design, shape, and size of structures within the scope of the present invention.

Having thus described the preferred embodiment of the invention, what is claimed as new and desired to be protected by Letters Patent includes the following:

1. A modular structure comprising:

a sill forming a base of the modular structure, the sill comprising:

a plurality of interlocking side members and a plurality of corner members, wherein each of said interlocking side members comprises an upper tab at a first end thereof and a lower tab at a second end thereof, wherein said upper and lower tabs each define an opening for receipt of a fastener therethrough, the upper tab of a first interlocking side member sized and shaped to mate with the lower tab of a second interlocking side member, and further wherein said interlocking side members and said corner members are fastened together to form a close sill; and a plurality of interlocking panels, wherein said plurality of interlocking panels are attached to one another to form a panel assembly having a first end and a second end, the first end of the panel assembly being attached to the sill at a first side of the sill and the second end of the panel assembly being attached to the sill at a second side of the sill.

2. A modular structure comprising:

a sill forming a base of the modular structure, the sill comprising a plurality of interlocking side members and a plurality of interlocking corner members, each of said interlocking side members comprising an upper tab at a first end thereof and a lower tab at a second end thereof, the upper tab of a first interlocking side member sized and shaped to mate with the lower tab of a second interlocking side member, the interlocking side members and interlocking corner members attached together to form a close sill;

a plurality of interlocking panels, said interlocking panels each comprising a first end, a second end, a first longitudinal edge, and a second, opposing longitudinal edge, the first and second longitudinal edges extending between the first and second ends, wherein each of said first longitudinal edge, second longitudinal edge, first end, and second end comprises a coupling joint, the coupling joint of the first end sized and shaped for attachment to the coupling joints of the second end, and the coupling joint of the first longitudinal edge sized and shaped for attachment to the coupling joints of the second longitudinal edge;

a first end piece attached to a first end of the sill and comprising a plurality of first end piece rib members and a plurality of first end piece panels, the plurality of first end piece rib members and plurality of first end piece panels attached to one another to form a completed first end piece;

a second end piece attached to a second, opposing end of the sill and comprising a plurality of second end piece rib members and a plurality of second end piece panels, the plurality of second end piece rib members and plurality of second end piece panels attached to one another to form a completed second end piece; and an arcuate rib extending from a first side of said sill to a second side of said sill, said arcuate rib disposed between said first and second end pieces, wherein each of said plurality of interlocking panels is attached to another of said plurality of interlocking panels to form a plurality of panels assemblies, each panel assembly having first and second opposing ends and first and second opposing longitudinal edges, the first and second opposing ends of the panel assemblies attached to said sill and the first and second opposing ends of the panel assemblies attached to a structure selected from the group consisting of another of said panel assemblies, an arcuate rib, the first end piece, and the second end piece, such that an enclosed modular structure is formed.

* * * * *